US005368907A

United States Patent [19]

Conboy

[11] Patent Number: 5,368,907

[45] Date of Patent: Nov. 29, 1994

[54] DRY WALL TAPE

[76] Inventor: John S. Conboy, 2235 Devonsbrook Dr., Chesterfield, Mo. 63005

[21] Appl. No.: 38,857

[22] Filed: Mar. 29, 1993

Related U.S. Application Data

[63] Continuation-in-part of Ser. No. 725,284, Jul. 3, 1991, abandoned, which is a continuation-in-part of Ser. No. 385,718, Jul. 27, 1989, Pat. No. 5,037,686.

[51] Int. Cl.[5] ..... B32B 3/08

[52] U.S. Cl. ..... 428/43; 428/61; 428/167; 428/172; 428/211; 428/220; 52/417

[58] Field of Search ..... 428/61, 167, 172, 211, 428/220, 43; 52/255, 288, 417

[56] References Cited

U.S. PATENT DOCUMENTS

| | | | |
|---|---|---|---|
| T 887,014 | 6/1971 | Overbay et al. | 52/417 |
| 2,181,530 | 11/1939 | Davenport | 52/417 |
| 2,314,523 | 3/1943 | Speer | 52/417 |
| 2,862,264 | 12/1958 | Perna | 52/417 |
| 4,313,991 | 2/1982 | Lamb | 52/255 |
| 4,722,153 | 2/1988 | Hardy | 52/255 |
| 4,835,925 | 6/1989 | Hoffmann, Sr. | 52/285 |
| 4,863,774 | 9/1989 | Tucker | 428/77 |
| 5,037,686 | 8/1991 | Conboy | 428/43 |

FOREIGN PATENT DOCUMENTS

| | | | |
|---|---|---|---|
| 18015/29 | 1/1929 | Australia | 52/417 |

*Primary Examiner*—Alexander S. Thomas

*Attorney, Agent, or Firm*—Polster, Lieder, Woodruff & Lucchesi

[57] ABSTRACT

A dry wall having a thin flexible paper base and two opposed beads which have circular corners spaced from the center line of the tape such that the tape can be bent in a 90° angle without the opposed beads interfering with each other. The tape allows the application of dry wall compound to both sides of the joint in the same application, because the beads on the tape provide a guide for the application tool so that the opposite edge of the joint is not disturbed when one side is being smoothed.

9 Claims, 2 Drawing Sheets

FIG. 1.
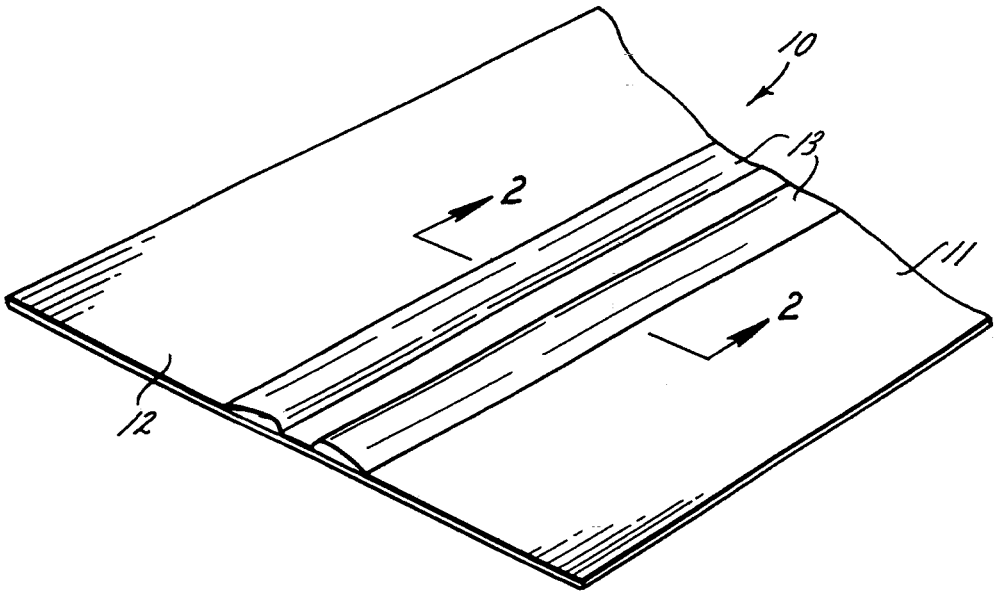
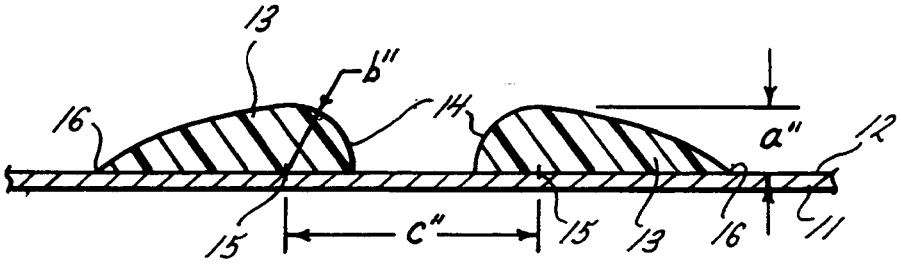
FIG. 2.
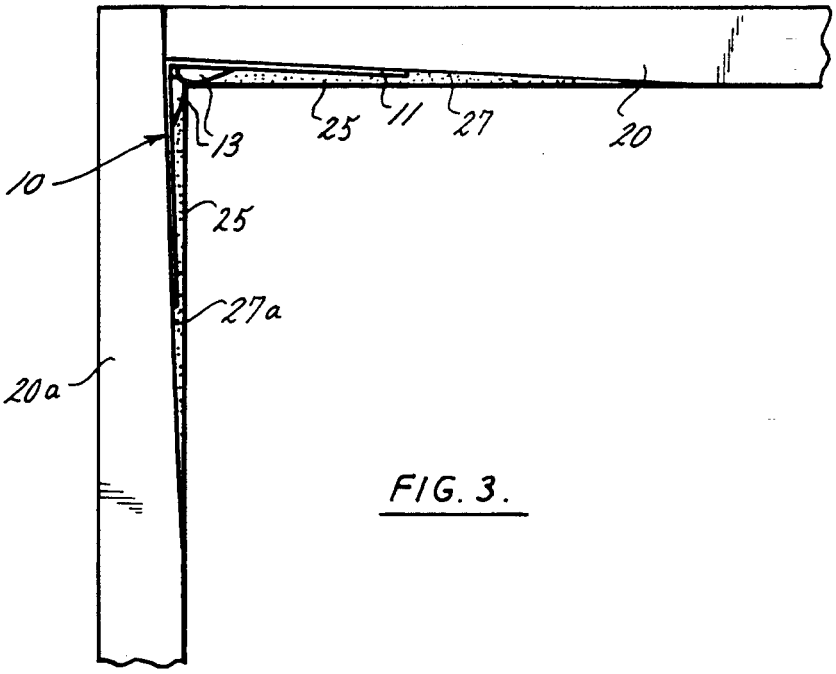
FIG. 3.

FIG. 5.
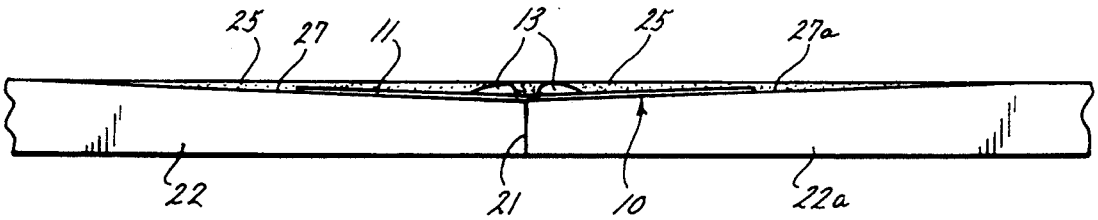
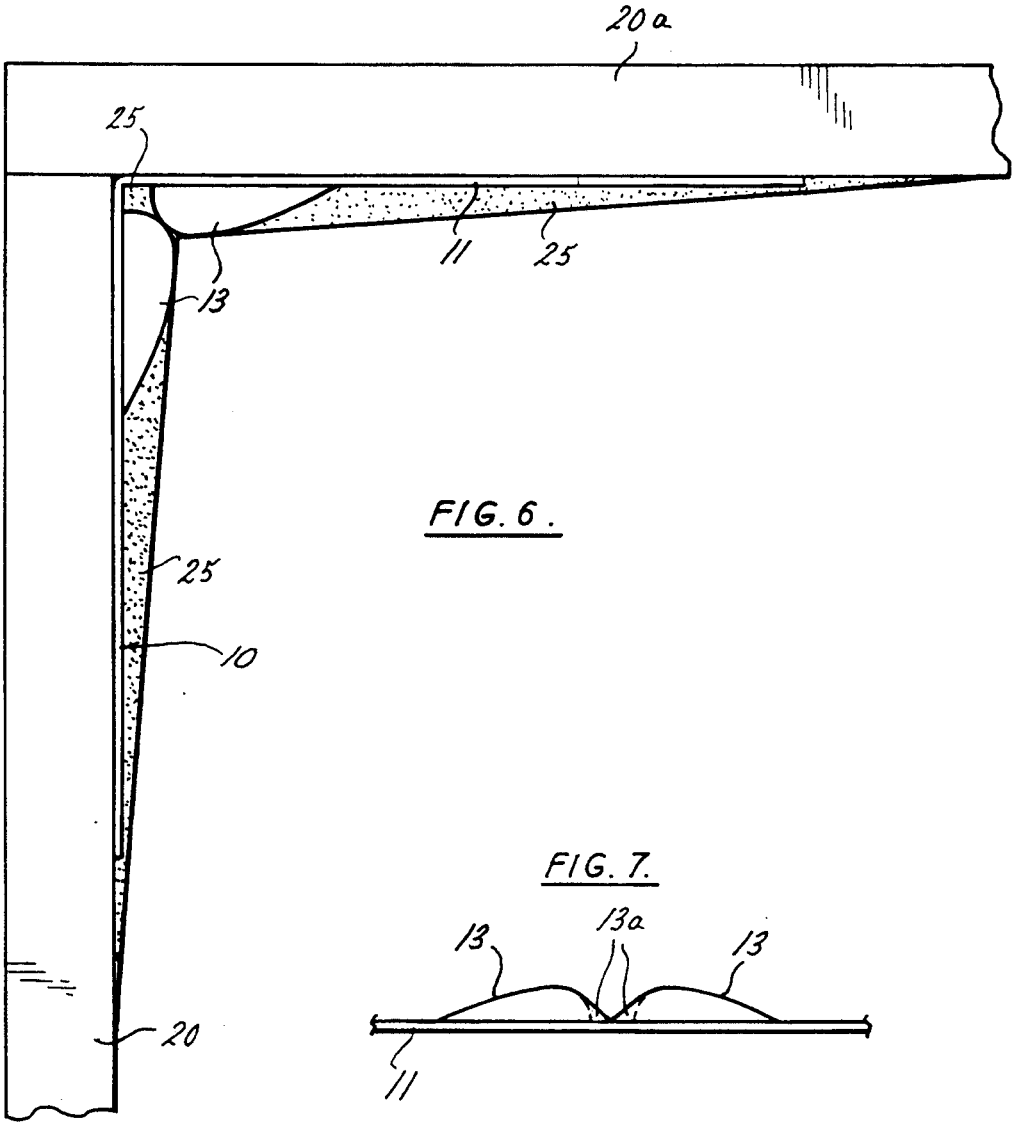
FIG. 6.
FIG. 7.
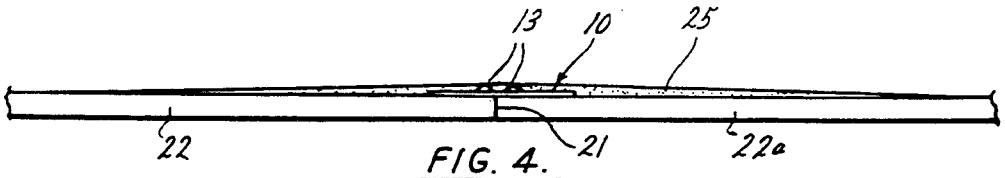
FIG. 4.

DRY WALL TAPE

REFERENCE TO PRIOR APPLICATIONS

This application is a continuation-in-part of Ser. No. 07/725,284, filed Jul. 3, 1991, now abandoned which is a continuation-in-part of Ser. No. 07/385,718 filed Jul. 27, 1989 (now U.S. Pat. No. 5,037,686 which issued on Aug. 6, 1991).

BACKGROUND OF THE INVENTION

This invention relates to dry wall tapes and particularly relates to a novel dry wall paper tape which is suitable for application to conventional corners of rooms, walls, ceilings, and angle corners of ceilings and bay windows, as well as on butt ends of dry wall applications. The tape of this invention is designed to save up to 30% of the time normally required for conventional dry wall application.

It is a principal object of this invention to provide a dry wall paper tape which can be used for both inside corners and butt ends of dry wall board. It is another principal object of this invention to provide a dry wall tape which will allow the person taping to rapidly form a straight line on an inside corner and which tape can also be applied to angled corners. It is still a further object to provide a dry will tape which has aligned spaced solid longitudinal beads thereon, and when applied to a corner, provides a straight solid guide so that the user can apply the precise amount of compound to both sides of the angle while the compound is in the uncured state without disturbing the opposite surface. Another object is to provide a tape which, when applied to the tapered edges of butting dry wall boards allows a smooth flat joint to be formed.

These and other objects and advantages will become apparent hereinafter.

SUMMARY OF THE INVENTION

The present invention comprises a paper tape having a set of outwardly curved beads separated by a center section so that the tape can be applied to an internal 90° joint without the beads conflicting.

The invention also consists in the parts and in the arrangements and combinations of parts hereinafter described and claimed.

BRIEF DESCRIPTION OF THE DRAWINGS

In the accompanying drawings which form part of the specification and wherein like numbers and letters refer to like parts wherever they occur —

FIG. 1 is a fragmentary perspective view of the tape of this invention;

FIG. 2 is a sectional view taken along line 2—2 of FIG. 1.;

FIG. 3 is a fragmentary end view of this invention applied to two intersecting walls;

FIG. 4 is a fragmentary side elevational view of end wall board panel butt ends with no taper;

FIG. 5 is a fragmentary side elevational view of the invention applied to two butting wall board panels with tapered edges;

FIG. 6 is a fragmentary enlarged side elevational view of the tape applied to an inside corner between a side wall and a ceiling wherein the dry wall board does not have tapered edges; and FIG. 7 is a fragmentary view of a modification of the present invention.

DETAILED DESCRIPTION

The preferred form of the invention is shown in FIGS. 1 and 2. The tape 10 comprises a thin paper base 11 which is about 0,005 to about 0,025 inches in thickness and about 2 to about 3 inches in width. The base 11 preferably is made of paper, but it can be made of any suitable flexible material which will not dissolve when it comes in contact with taping compound. Paper is prefered for the tape base 11 because when the tape 10 is bent to conform to a corner in a room, the paper will tend to hold its shape and will not spring back to its original flat shape. The base 11 is about 0.005 to about 0.025 inches in thickness and about 2 to about 3 inches in width. Preferably the base 11 is about 0.012 inches in thickness and about 2.5 inches in width.

Positioned on the base upper surface 12 are two aligned spaced beads 13. The beads 13 run the longitudinal length of the tape 10 and are made of a thin polymeric material or other suitable flexible material which will retain its shape when used as a base for a knife or other tool used to apply taping compound.

The beads 13 are made of a material which will break when bent over about 120° so that the tape 10 can easily be formed into the desired lengths without using a cutting instrument. The paper base 11, of course, can be torn to the desired length.

The beads 13 have a thickness from about 0.025 to about 0.1 inches designated by the letter "a" in FIG. 1. The preferred thickness is about 0.050 inches which conforms to the depth of the taper of a typical dry wall board. The inside edge 14 of each of the beads 13 is the radius of a circle based on the base surface 12 at the point 15. This radius is indicated by the letter "b" in FIG. 1. The distance between the center points 15 of the circles is about 2 times the radius "b" times the $\sqrt{2}$. ($2b\times\sqrt{2}$). This distance is indicated by the letter "c" in FIG. 1. Thus the distance from the centerline of the tape 10 to the point 15 is b $\sqrt{2}$.

The distances from the center line of the tape 10 to the outside edges 16 of each of the beads 13 is about 0.25 to about 0.35 inches, preferably about 0.25 inches. The radius of the beads 13 is about 0.025 to about 0.075 inches, preferably about 0.05 inches.

The beads 13 are positioned on the paper base 11 and the radii are selected such that the beads 13 touch when the tape 10 is folded in a 90° angle (FIG. 5). The beads 13 do not interfere with the folding of the tape 10 until after a fold of 90° is made.

FIGS. 3 and 6 show the tape 10 applied to an inside corner of a room which could be where two walls meet or where a wall meets a ceiling. Under these circumstances the tape 10 is bent in a 90° angle and the beads 13 do not interfere with each other during the bending of the tape base 11. At the same time, the beads 13 define points on which the user can bear his taping tool to provide a smooth taped finish.

FIG. 3 shows the dry wall board **20,20*a* as having tapered edges 27,27*a*. The tape 10 and beads 13 fill up the taper so that a straight flat joint is formed. FIG. 6 shows the dry wall boards 20,20*a*** as having flat surfaces where they meet. This will occur if the boards are cut from larger pieces.

FIGS. 4 and 5 show the tape 10 applied to a butt joint 21, such as the joint between the lateral 8' edges of two 4×8 sections of wall board **22,22*a* laid on a wall or ceiling of a room. In this situation, the tape 10 is applied over the joint 21 so that the center line of the tape 10 is in alignment with the joint line and the tape 10** fills in the taper to form a smooth flat joint.

FIG. 4 shows the tape 10 applied to a straight butt joint 21 with no taper. The compound is feathered out to about 12" on each side of the joint 21 so that the joint 21 appears flat to a viewer. The beads 13 make it easy for the installer to apply exact amounts of taping compound over paper at joints (butt ends) so that butt ends have a small crown that is tapered out over a 24" area so that the joint appears flat. The installer can complete the job in one pass.

FIG. 5 shows the tape 10 applied to a joint 21 formed are by tapered wall boards 22,22*a*. In this case the beads 13 the same height as the depth of the tapered edges 27,27*a* so that in fact, a flat joint 21 is achieved when taping compound is applied.

Another modification of the tape 10 is shown in FIG. 7 wherein the beads 13 have a taper 13*a* toward the centerline of the paper 11. The additional material 13*a* allows the tape 10 to be folded at the centerline and prevents the beads 13 from running over each other. At the same time, the additional material 13*a* does not interfere with the folding of the tape 10. In fact, the distance between the tapers 13*a* forms a guide for accurate folding of the tape 10.

In using this tape, the first step is that the user will apply taping compound 25 to the joint. Next he presses the paper tape 10 into the taping compound either in a corner with the tape 10 folded at a 90° angle (as shown in FIGS. 3 and 6) or to a butt joint with the tape 10 flat (as shown in FIGS. 4 and 5). At this point, additional taping compound 25 can be applied to the entire joint and the joint can be completed by the taper in one pass through the room.

The conventional taping procedure requires that the taping compound be applied to the joints or corners and that the tape be applied to all of the joints or corners and allowed to cure, normally one day. After the tape compound is cured, the normal procedure is that taping compound is applied to one side of each corner joint and smoothed out. When these are cured, taping compound is applied to the other side of the corner joints and these are smoothed. Thus, the taper has to make two complete trips through the house. This usually requires several days of taping, followed finally when the taping compound is dried by the conventional final sanding step. The present tape allows the user to apply the exact amount of dry wall compound to both sides of the angle while the compound is still in its uncured state without disturbing the opposite surface. On high quality jobs this will save an estimated 30% of installation time and will provide a straighter more uniform corner or butt.

A butt joint is a very difficult joint to apply and using the present tape a very flat joint is obtained which is not visible to the naked eye by applying just enough taping compound to cover paper of tape. Butt joints are normally tapered out 12" on each side to form a joint 24" total width. Use of the present beaded tape allows the installer to lay compound on both sides of joint at one pass. Using conventional taping procedures and conventional tape it is very difficult for the taper to get a good corner joint in one application because the knife tends to gouge into the opposite part of the joint because there is nothing to lay the edge of the knife on to give it a guide to run against.

Thus it is seen that the present invention achieves all of the objects and advantages sought therefore and this invention is intended to cover all changes and modifications of the example of the invention herein chosen for purposes of the disclosure which do not constitute departures from the spirit and scope of the invention.

What is claimed is:

1. A dry wall tape comprising (a) a thin paper base, (b) a pair of opposed longitudinal beads positioned on the upper surface of the base and equally spaced from each other on each side of the longitudinal centerline of the base, the area on the base between the beads being open, (c) the inside edges of the beads being the radii of circles based on the surface of the base, the distance between centers of said circles being about 2 times the radius times the $\sqrt{2}$.

2. The tape of claim 1 wherein the base is about 0.005 to about 0,025 inches in thickness and about 2 to about 3 inches in width.

3. The tape of claim 1 wherein the beads have a thickness of from about 0,025 to about 0.1 inches.

4. The tape of claim 1 wherein the distance from the center of the tape to the outside edges of each of the beads is about 0.25 inches.

5. The tape of claim 1 wherein the radii of the beads is about 0.05 inches.

6. The tape of claim 1 wherein the base is about 0.015 inches in thickness and about 2.5 inches in width.

7. A dry wall tape comprising (a) a thin paper base, (b) a set of opposed longitudinal beads positioned on the upper surface of the base and equally spaced from each other on each side of the longitudinal centerline of the base, (c) the inside edges of the beads being the radii of circles based on the surface of the base, the distance between centers of said circles being about 2 times the radius times the $\sqrt{2}$, and (d) the beads tapering toward each other and terminating adjacent to the centerline of the tape to define a longitudinal fold line.

8. In the combination of a room construction comprising adjoining dry wall boards having tapered edges and dry wall tape, the improvement comprising a dry wall tape having (a) a thin paper base, (b) a set of opposed longitudinal beads positioned on the upper surface of the base and equally spaced from each other on each side of the longitudinal centerline of the base, (c) the inside edges of the beads being the radii of circles based on the surface of the base, the distance between centers of said circles being about 2 times the radius times the $\sqrt{2}$, (d) the beads tapering toward each other and terminating adjacent to the centerline of the tape to define a longitudinal fold line, and (e) said dry wall tape being positioned in the tapered areas of the dry wall board with the base toward the dry wall and the beading facing away from the dry wall to provide a smooth flat surface to the board when covered with dry wall compound,

9. A dry wall tape comprising (a) a thin paper base, (b) a set of opposed longitudinal beads positioned on the upper surface of the base and equally spaced from each other on each side of the longitudinal centerline of the base, the beads being a frangible material which will break when bent at an angle of greater than about 120°, (c) the inside edges of the beads being the radii of circles based on the surface of the base, the distance between centers of said circles being about 2 times the radius times the $\sqrt{2}$.

* * * * *